US008726688B2

(12) United States Patent
Ghiraldi

(10) Patent No.: US 8,726,688 B2
(45) Date of Patent: May 20, 2014

(54) REFRIGERATOR FOR FRESH PRODUCTS WITH TEMPERATURE LEVELING MEANS

(75) Inventor: Alberto Ghiraldi, Olgiate Molgora (IT)

(73) Assignee: Nomos S.R.L., Vimercate (IT)

( * ) Notice: Subject to any disclaimer, the term of this patent is extended or adjusted under 35 U.S.C. 154(b) by 972 days.

(21) Appl. No.: 12/665,515

(22) PCT Filed: Jun. 18, 2008

(86) PCT No.: PCT/EP2008/057692
§ 371 (c)(1),
(2), (4) Date: Dec. 18, 2009

(87) PCT Pub. No.: WO2009/000722
PCT Pub. Date: Dec. 31, 2008

(65) Prior Publication Data

US 2010/0170286 A1 Jul. 8, 2010

(30) Foreign Application Priority Data

Jun. 22, 2007 (IT) ..... MI2007A1259

(51) Int. Cl.
*F25D 11/04* (2006.01)

(52) U.S. Cl.
USPC ..... 62/438; 62/530

(58) Field of Classification Search
USPC ..... 62/434, 438, 440, 498, 530
See application file for complete search history.

(56) References Cited

U.S. PATENT DOCUMENTS 2,973,630 A * 3/1961 Kriechbaum ..... 62/139
4,526,612 A * 7/1985 Eriksson et al. ..... 75/10.17
4,815,287 A * 3/1989 O'Daniel ..... 62/430
5,235,819 A * 8/1993 Bruce ..... 62/60
6,092,381 A * 7/2000 Hsiao et al. ..... 62/237
6,318,114 B1 * 11/2001 Slaughter ..... 62/457.2
7,640,764 B2 * 1/2010 Gammons et al. ..... 62/259.3

FOREIGN PATENT DOCUMENTS

| | | |
|---|---|---|
| CN | 201152662 Y | 11/2008 |
| DE | 33 33 012 A1 | 3/1985 |
| DE | 33 33012 | 3/1985 |
| EP | 0 974 794 | 1/2000 |

OTHER PUBLICATIONS

Chinese Office Action from the Chinese Patent Office in the corresponding co-pending application 200880021444.6.

* cited by examiner

*Primary Examiner* — Melvin Jones
(74) *Attorney, Agent, or Firm* — Greer, Burns & Crain Ltd.

(57) ABSTRACT

A refrigerator for fresh and frozen products with passive elements for temperature leveling without ventilation and for maintaining the relative humidity above 90% even in the absence of a connection to the electrical mains, by using the energy supplied by the melting enthalpy of the thermal mass, frozen beforehand by circulating refrigeration fluid at low temperature within a heat accumulator, which allows to absorb the heat that passes through the walls and the heat dissipated by the products, the refrigerator comprising a body which defines internally at least one compartment which is delimited by thermally insulating walls, at least 50% of the inner surface of the compartment being constituted by the surface of a heat accumulator containing a eutectic liquid, with a phase change temperature which is proximate to the temperature to be maintained within the compartment, an evaporation circuit associated with a compressor being connected to the heat accumulator.

19 Claims, 4 Drawing Sheets

REFRIGERATOR FOR FRESH PRODUCTS WITH TEMPERATURE LEVELING MEANS

TECHNICAL FIELD

The present invention relates to a refrigerator for fresh and frozen products with passive means for leveling the temperature.

BACKGROUND ART

As is known, the critical requirements for preserving fresh perishable products are maintaining the temperature as close as possible to the maximum freezing point, which is typically below 0° C., maintaining the humidity at values above 90%, and absence of ventilation.

As is known, the variation of the coefficients of deterioration as the preservation parameters vary is not linear with the variation and interaction thereof, so that for example, when using the typical values of a conventional or industrial refrigerator, there is on average a temperature which oscillates from +2 to +5° C., with a relative humidity of approximately 60% and an internal ventilation, and therefore the deterioration coefficient is greater than 5, thus reducing to less than one fifth the useful life of the products.

Currently commercially available refrigerators are typically provided with a preservation compartment, which is thermally insulated and inside or in contact with which there is an evaporation circuit, constituted by a coil or plate, which is connected to a compressor so that in the evaporation circuit that is present inside the refrigerator there is a direct expansion of the gas, so that one is in the presence of temperatures which are significantly lower than the temperature values of such preservation compartment, such temperature difference being normally over 10° C.

The temperature inside the preservation compartment is regulated by a thermostat, and therefore operation of the refrigerator is of the on-off type.

This type of operation causes extreme dehydration of the air due to the high $\Delta T$ between the temperature of the evaporating gas and the environment, with consequent desiccation of the preserved products; moreover, there are continuous oscillations of the temperature inside the preservation compartments due to the type of operation of the compressor.

The use of a thermostat introduces the need to adjust the temperature inside the preservation compartment, so as to take into account the hysteresis of the thermostat and its precision.

The type of construction and operation inevitably causes unevenness in the temperature inside the compartment, and moreover, due to the great differential in temperature between the air and the evaporating gas, one has a surface at a negative temperature, which in case of direct contact with the fresh products damages them by freezing.

Another problem further consists in that the energy consumption of a conventional refrigerator is concentrated predominantly in the warm hours of the day, which correspond to the overload periods of electrical mains.

Another problem further consists in that, particularly for fresh products, if the electric power supply is not available, there is a rapid temperature variation which damages the product.

DISCLOSURE OF THE INVENTION

The aim of the invention is to eliminate the drawbacks noted above, by providing a refrigerator for fresh and frozen products with passive means for leveling the temperature, which allows to eliminate the continuous oscillations of the temperature within the preservation compartment due to the type of operation of the compressor, obtaining a temperature profile which is substantially constant, differently from the profile of traditional technology, which is characterized by continuous oscillations of the temperature due to thermal cycles, which accelerate the aging of the product that one seeks to preserve.

Within this aim, an object of the invention is to be able to adjust the temperature of the interior of the preservation compartment without being affected by the negative effects caused by the hysteresis and possible lack of precision of the thermostat.

Another object of the present invention is to provide a refrigerator which allows to shift energy consumption from the daytime period to the night hours, which entails, if the technology is applied systematically, both a reduction of a considerable amount of $CO_2$ emissions, since it is possible to use the marginal electric power that is currently unused or only partially used, and a reduction of consumption, since there is a higher efficiency of the compressors due to the higher evaporation temperature and the lower night temperature.

Another object of the present invention is to provide a refrigerator in which it is possible to maintain the temperature and relative humidity values within the design parameters, regardless of the availability or not of continuity of the electric power supply.

Still another object of the present invention is to provide a refrigerator which, thanks to its particular constructive characteristics, is capable of giving the greatest assurances of reliability and safety in use.

This aim and these and other objects, which will become better apparent hereinafter, are achieved by a refrigerator for fresh and frozen products with passive means for temperature leveling, comprising a body which forms internally at least one compartment which is delimited by thermally insulating walls, characterized in that at least 50% of the inner surface of said compartment is constituted by the surface of a heat accumulator which contains a eutectic liquid, with a phase change temperature which is proximate to the temperature to be maintained within said compartment, an evaporation circuit associated with a compressor being functionally connected to said heat accumulator.

BRIEF DESCRIPTION OF THE DRAWINGS

Further characteristics and advantages of the invention will become better apparent from the description of a preferred but not exclusive embodiment of a refrigerator for fresh and frozen products with passive temperature leveling means, illustrated by way of non-limiting example in the accompanying drawings, wherein.

WAYS OF CARRYING OUT THE INVENTION

Figure 1:
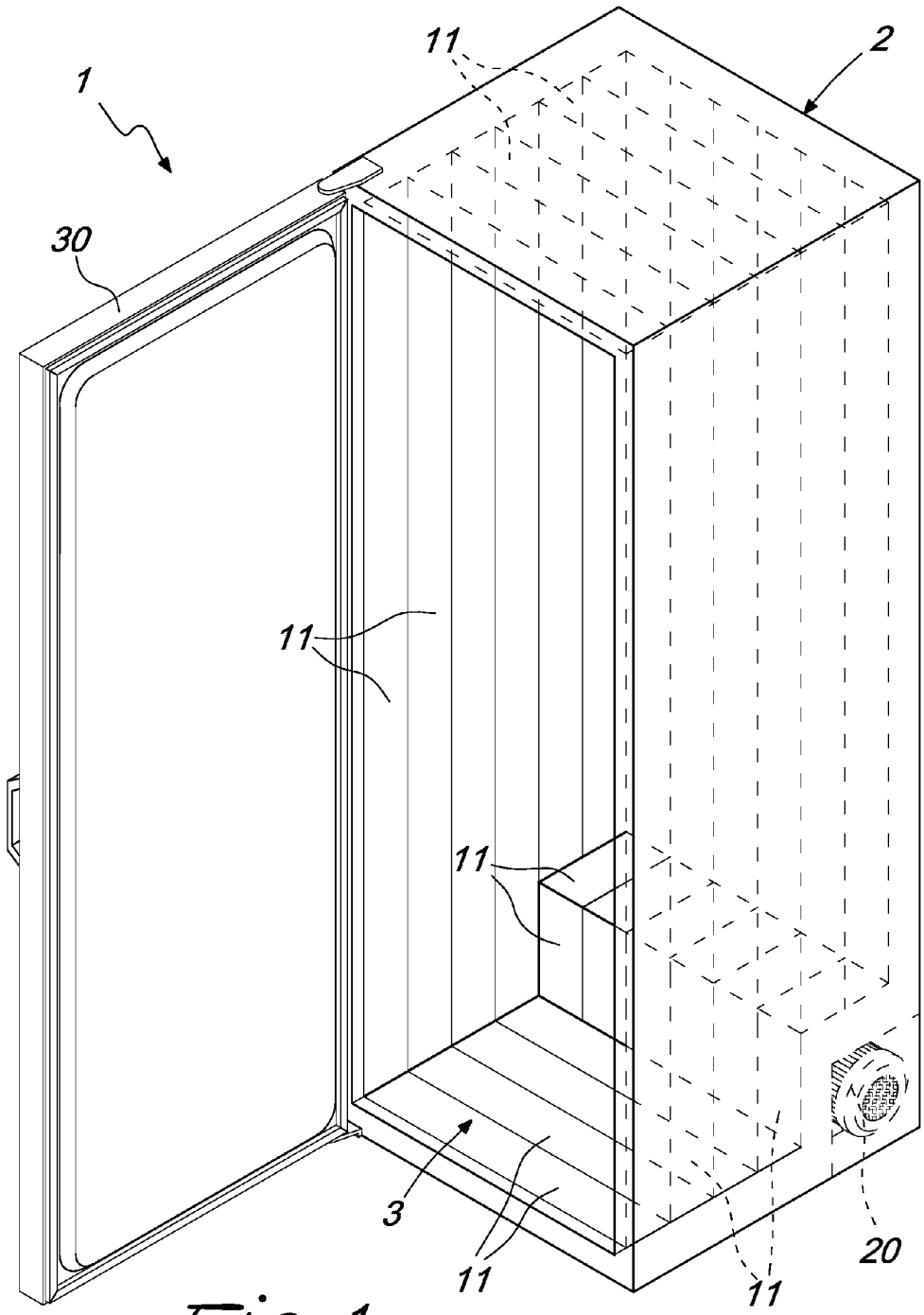
FIG. 1 is a schematic perspective view of the refrigerator.
Figure 2:
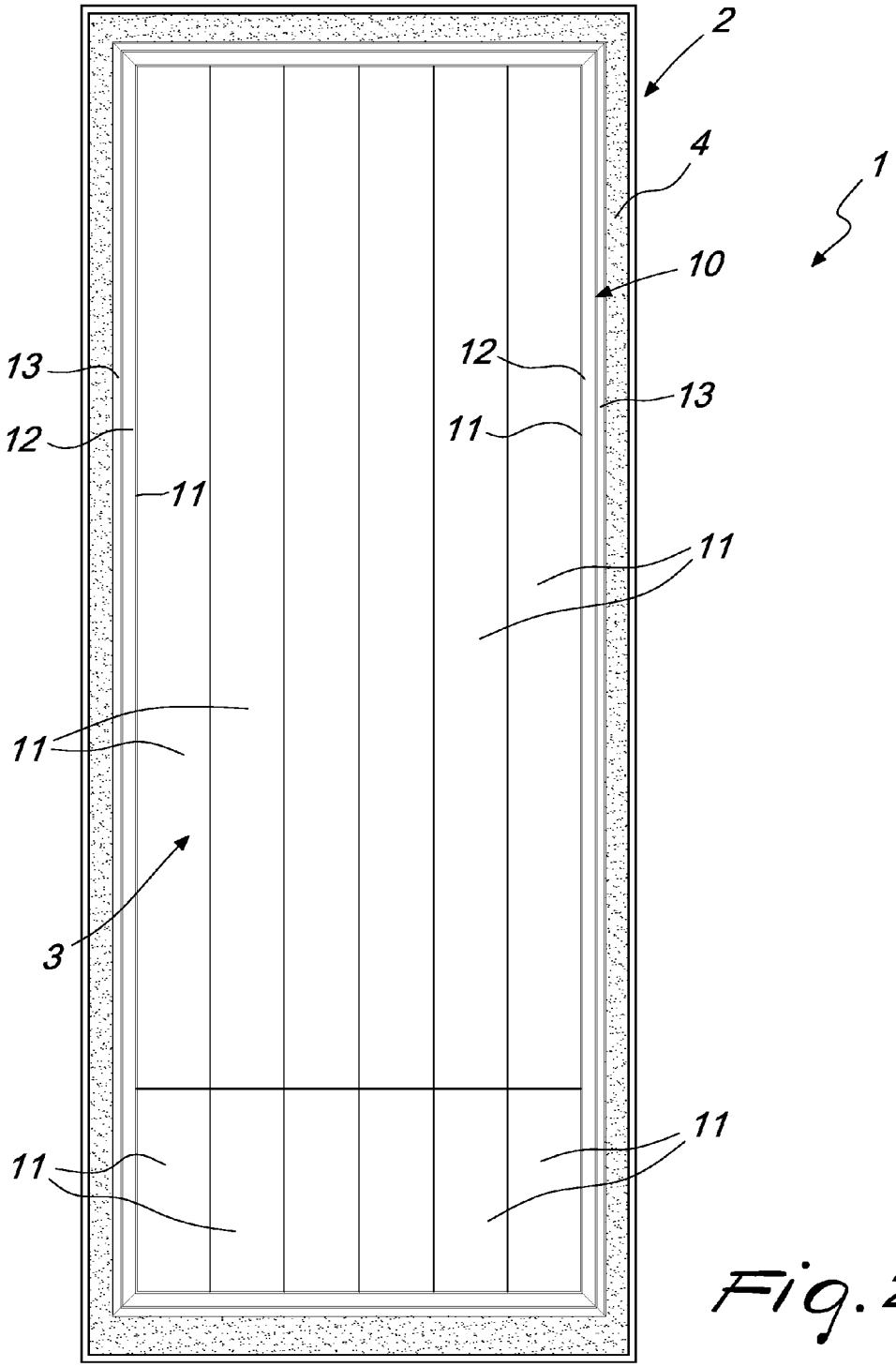
FIG. 2 is a sectional view of the refrigerator, taken along a vertical plane.

With reference to the figures, the refrigerator for fresh and frozen products with passive temperature leveling means, generally designated by the reference numeral 1, comprises a body 2, shaped in any manner, which forms internally at least one compartment or chamber, generally designated by the reference numeral 3, which is delimited by thermally insulating walls, designated by the reference numeral 4.

The thermally insulating walls can be obtained, in a per se known manner, by means of the traditional sheet metal that provides the outer surface and contains expanded material; it is optionally also possible to achieve thermal insulation by creating a wall in which vacuum is provided.

The peculiar feature of the invention is constituted by the ability to use the energy provided by the melting enthalpy of the thermal mass, previously frozen by circulating refrigerating fluid at a low temperature inside the heat accumulator, in order to maintain optimum relative humidity and temperature conditions by means of the absorption, which is progressive and proportional to demand, of the heat that passes through the walls and the heat dissipated by the products.

The modulating operation, the exchange surface/volume ratio and the accumulated energy/volume ratio allow to absorb rapidly the transients caused by the opening of the doors and to contain the variations of the internal temperature over 24 hours to values <+/−1° C., while the ΔT<4° C. between the air and the surface itself avoids the dehumidification of the air, making any defrosting function unnecessary. This performance is achieved due to the fact that most of the inner surface of the compartment 3, for a surface of at least 50%, is constituted by the surface of a heat accumulator, generally designated by the reference numeral 10, which has an inner surface 11 which forms the internal wall of the surface of the compartment 3.

The heat accumulator can be obtained from two shells made of metallic material or plastics, in which the inner shell delimits the preservation compartment and the outer shell surrounds the first shell for most of its surface and is welded thereon along the the entire perimeter.

The container thus provided contains the eutectic liquid and is in contact with the insulation.

In order to avoid deformations caused by hydrostatic pressure, the two shells are connected to each other mechanically but not thermally.

Figure 3:
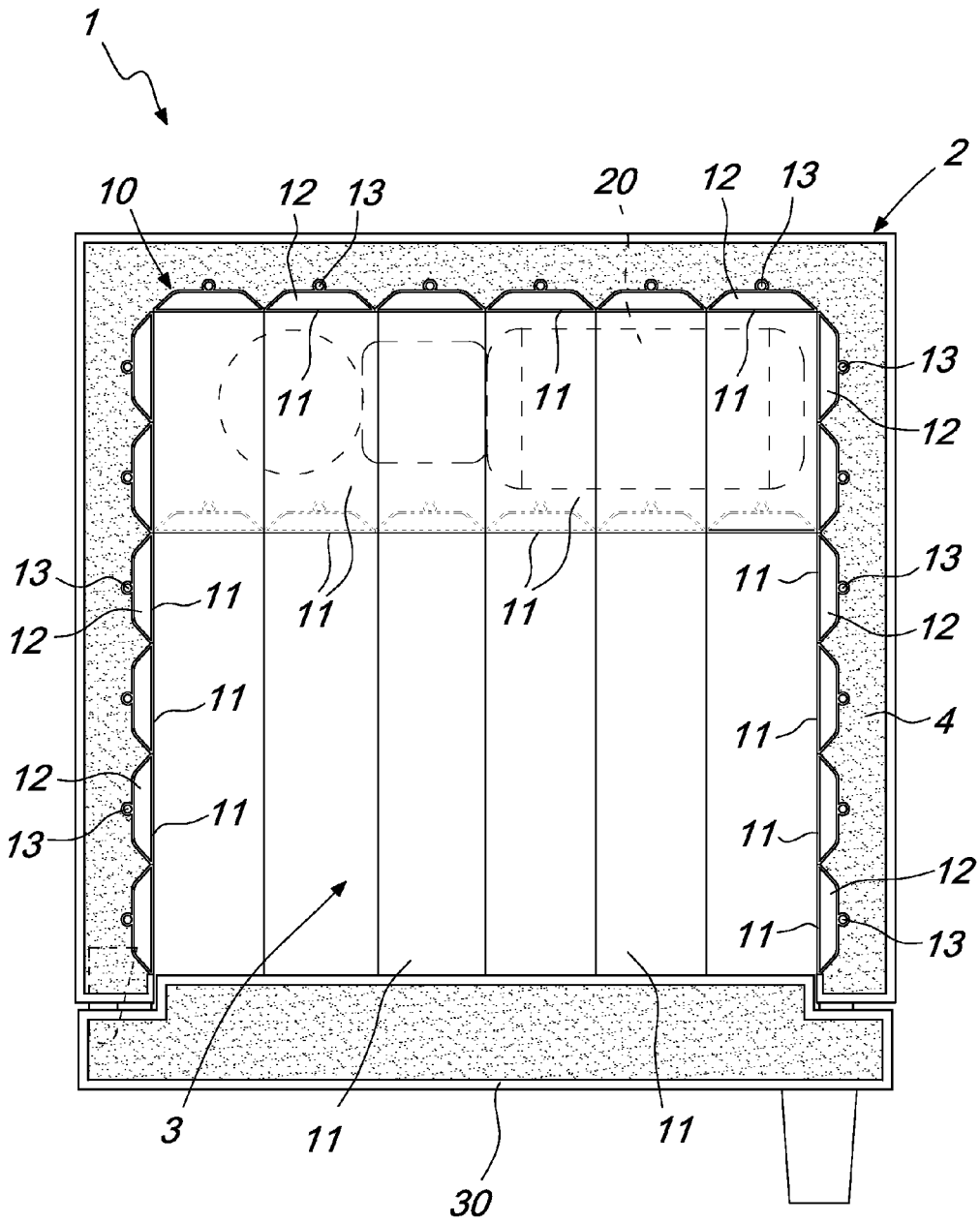
FIG. 3 is a schematic sectional view of the refrigerator, taken along a horizontal plane.
Figure 4:
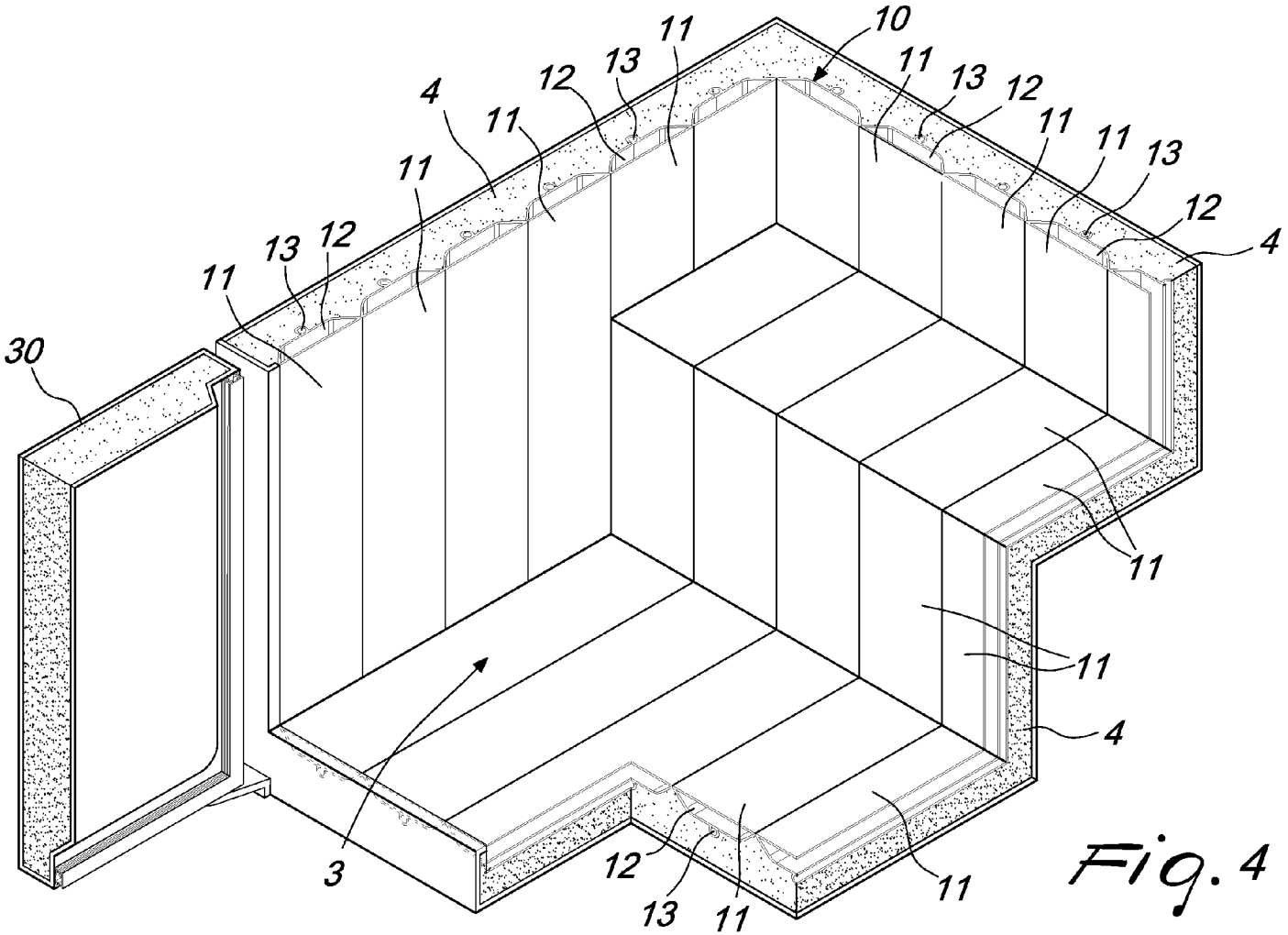
FIG. 4 is a perspective view of a cutout of the refrigerator, illustrating its components.

According to what is shown in particular in FIG. 3, it is also possible to provide box-like elements which are arranged in mutual contact and in practice are provided by an extruded element which forms an inner wall 11, which is directed toward the compartment 3, and an outer wall 12, which is directed toward the expanded material.

The profiles thus provided are sized so as to avoid deformations caused by hydrostatic pressure and the positive or negative volume variations are in practice absorbed by the inner wall of the heat accumulator with deformations which remain within the elastic range of the material.

A eutectic liquid is placed internally.

The heat accumulator is connected to an evaporation circuit which, in the case of half-shells, can be arranged inside such half-shells and in the case of profiles is constituted by a tubular body 13 arranged on the outside of the profile, so as to be as distant as possible with respect to the edges that come into contact with the interior; accordingly, the tubular body or element 13 is arranged at a central portion of a wall 14 of the profile that is directed toward the insulating wall 4. A peculiarity of the invention is constituted by the fact that a ΔT<8° C. is maintained between the refrigerating fluid that circulates in the evaporation circuit and the temperature inside the compartment 3, thus contributing to a substantial energy saving.

With this arrangement, it is possible to not absorb heat at the end of the box-like body where there is direct thermal contact constituted by the edge.

In order to allow the uniform transition of state within the entire eutectic liquid contained in the box-like element, the thermal resistance constituted by the outer wall 12 must be equivalent to the thermal resistance of the contained eutectic liquid.

The tubular element which in practice constitutes the coil can be co-extruded with the box-like elements, thus providing a monolithic body.

In order to allow a uniform temperature distribution within the compartment 3 and a ΔT between the phase change temperature of the eutectic liquid and the temperature of the preservation compartment of less than 4° C., the ratio between the surface in square meters of the compartment and the volume in cubic meters of the compartment 3 must be greater than 3.5.

With this arrangement, the temperature of the inner surface of the heat accumulator has differentials of less than 2° C. between the warmest point and the coldest point.

With the described arrangement, in practice the eutectic liquid contained in the heat accumulator provides a thermal filter which is interposed between the evaporation circuit and the preservation compartment, which attenuates the temperature oscillations which are inherent in on-off operation and allows to maintain in all points such a temperature as to avoid defrosting and damage to the products in contact with the surface of the preservation compartment.

With this arrangement, by maintaining the temperature oscillations caused by on-off operation of the compressor at values lower than +/−1° C., a virtually flat temperature profile is obtained.

For this purpose, the eutectic liquid interposed between the evaporating gas and the inner wall of the preservation compartment or chamber must have an average thickness of more than 5 mm and must maintain, in standard operating conditions, a liquid phase percentage of approximately 10% at the end of the charge and of solid state of substantially 30% at the end of the discharge.

The liquid phase/solid phase percentage is obtained by checking the temperature of the eutectic liquid and stopping/starting the compressor in the presence of a ΔT of +/− two tenths of a degree with respect to the nominal state transition value.

With the described solution it is possible to keep the temperature in the preservation compartment constant even without the operation of the compressor caused by lack of mains power or possibly by operation which is programmed only during night hours in order to reduce energy costs and daytime consumption at peak hours; to achieve this, the melting enthalpy of the eutectic liquid must have such a value as to allow to absorb all the heat that derives from the heat flow caused by conductance, by repeated door openings, and by the refrigeration of a specific quantity of product.

The compressor can be of the type with direct expansion of gas at high pressure, with a typical evaporation temperature from −5 to 1° C.

The compressor can be connected directly to the refrigerator body or optionally can be associable detachably with the evaporation circuit by means of tubes provided with quick couplings which allow even unskilled people to disconnect and connect the refrigeration circuit.

Moreover, the refrigerator, once disconnected from the compressor, can constitute a means of transport which is autonomous in terms of heat and energy and is capable of maintaining the internal temperature and relative humidity values for a period ranging from 1 to 30 days.

Operation, as mentioned above, can be preset in specific time bands.

Experimental tests that have been conducted have shown that the presence of the heat accumulator, which in practice constitutes a thermal filter, allows to obtain a ΔT between the inner wall and the interior of the compartment of less than 4° C., with an average thickness of the eutectic liquid in the heat accumulator of more than 5 mm on a surface which is greater than 3.5 $m^2/m^3$.

This surface to volume ratio also allows to keep the ΔT between the top and the bottom of the inner compartment below 2° C., and in order to obtain this value it is advisable, in the case of the double-shell heat accumulator, to prepare the density of the coils of the evaporator which decreases progressively from the top downwardly, with an average center distance of 60 mm, a minimum center distance of 30 mm and a maximum center distance of 90 mm, with a uniformly distributed variation.

In the case of the version of the heat accumulator with box-like elements, as shown in the drawings, it is advisable to have an evaporation circuit with a constant pitch with expansion of the gas preferably from the top downwardly.

From what has been described it can be seen that the invention achieves the proposed aim and objects, and in particular the fact is stressed that a refrigerator is provided which modifies the traditional techniques for providing refrigerators, since a heat accumulator is used which, by remaining interposed between the evaporation circuit and the preservation compartment, creates a filter such that the temperature gradient within the preservation compartment is always strictly lower than 4° C.

Moreover, the accumulation that derives from the phase change of the eutectic liquid allows to maintain the compressor in operation substantially only during night hours, always having the certainty of maintaining an optimum level of temperature inside the refrigerator.

The invention thus conceived is susceptible of numerous modifications and variations, all of which are within the scope of the appended claims.

All the details may further be replaced with other technically equivalent elements.

In practice, the materials used, so long as they are compatible with the specific use, as well as the contingent shapes and dimensions, may be any according to requirements.

The disclosures in Italian Patent Application no. MI2007A001259, from which this application claims priority, are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A refrigerator for fresh products with passive means for temperature levelling without using ventilation, comprising a body which forms internally at least one compartment which is delimited by thermally insulating walls, wherein at least 50% of an inner surface of said compartment is constituted by a surface of a heat accumulator which contains a eutectic liquid, with a phase change temperature which is proximate to a temperature to be maintained within said compartment, an evaporation circuit associated with a compressor being functionally connected to said heat accumulator, and wherein a ration between the surface in square meters of said compartment and the volume in cubic meters of said compartment is provided greater than 3.5, said evaporation circuit being arranged so that, in operation, a ΔT<8° C. is maintained between refrigeration fluid that circulates therein and the temperature inside said compartment.

2. The refrigerator according to claim 1, wherein said heat accumulator defines an inner surface which constitutes the inner wall of said compartment, said inner surface delimiting a cavity for accommodating said eutectic liquid.

3. The refrigerator according to claim 2, wherein said heat accumulator is constituted by two shells, in which an inner shell delimits said compartment and an outer shell wraps around the inner shell for most of the surface and is connected along the entire perimeter thereon, points of thermally insulated mechanical connection being provided between said shells.

4. The refrigerator according to claim 3, wherein said evaporation circuit is thermally associated with said outer shell and is arranged outside said cavity.

5. The refrigerator according to claim 3, wherein said evaporation circuit is provided monolithically with box-like elements which are arranged in mutual contact and define said inner wall.

6. The refrigerator according to claim 5, wherein a tubular body of said evaporation circuit is arranged on the outside of each of said box-like elements.

7. The refrigerator according to claim 6, wherein said tubular body arranged on the outside of a said box-like element is arranged so as to be equidistant with respect to edges of the box-like element, said edges being into contact with a portion of said box-like element that forms said inner wall.

8. The refrigerator according to claim 1, wherein the ΔT between the phase change temperature of said eutectic liquid and the temperature in said compartment is less than 5° C.

9. The refrigerator according to claim 1, wherein the temperature of the inner surface of said heat accumulator has differentials of less than 2° C. between a warmest point and a coldest point.

10. The refrigerator according to claim 4, wherein the eutectic liquid interposed between said evaporation circuit and said inner wall has an average thickness of more than 5 mm.

11. The refrigerator according to claim 1, wherein said heat accumulator, in standard operating conditions, has a liquid phase percentage of approximately 10%, at the end of the charge, and a solid state percentage of substantially 30%, at the end of the discharge, thus providing a thermal filter which is interposed between the evaporation circuit and the inner wall and is capable of absorbing the temperature fluctuations of said evaporation circuit caused by operation and stopping of the compressor.

12. The refrigerator according to claim 11, wherein the liquid phase/solid phase percentage is obtained by means for controlling the temperature of the eutectic liquid to start and stop the compressor in the presence of a ΔT of +/− two tenths of a degree with respect to a nominal state transition value.

13. The refrigerator according to claim 1, wherein said heat accumulator affects the lateral inner surfaces of said compartment except for closure door, bottom and ceiling.

14. The refrigerator according to claim 1, further comprising a timer which drives the operation of the compressor of said evaporation circuit at preset times of day, preferably during night hours.

15. The refrigerator according to claim 14, further comprising means for the automatic actuation of said compressor when the charging conditions of the heat accumulator cease, independently of said timer.

16. The refrigerator according to claim 6, wherein with the two shell heat accumulator, a density of coils of the tubular body of the evaporation circuit decreases progressively from the top downwardly, with an average center distance of 60 mm, a minimum center distance of 30 mm and a maximum center distance of 90 mm, with a uniformly distributed variation.

17. The refrigerator according to claim 1, wherein it maintains relative humidity values >90% without independent humidification means.

18. The refrigerator according to claim 1, wherein the compressor is external to the body of said refrigerator and can be connected detachably to said evaporation circuit by means of tubes provided with quick couplings.

19. The refrigerator according to claim 1, wherein after the disconnection of said compressor, said refrigerator becomes a means of transport which is autonomous in terms of heat and energy and is capable of maintaining the internal temperature and relative humidity values for a period ranging from 1 to 30 days.

* * * * *